US008099025B2

(12) United States Patent
Ishikake

(10) Patent No.: US 8,099,025 B2
(45) Date of Patent: Jan. 17, 2012

(54) TONER STIRRING DEVICE HAVING A PUSHING MEMBER AND ROTATION MEMBER FOR AN IMAGE FORMING APPARATUS

(75) Inventor: Satoru Ishikake, Kawasaki (JP)

(73) Assignee: Ricoh Company Ltd., Tokyo (JP)

( * ) Notice: Subject to any disclaimer, the term of this patent is extended or adjusted under 35 U.S.C. 154(b) by 372 days.

(21) Appl. No.: 12/423,328

(22) Filed: Apr. 14, 2009

(65) Prior Publication Data

US 2009/0257782 A1 Oct. 15, 2009

(30) Foreign Application Priority Data

Apr. 15, 2008 (JP) ..... 2008-105554
May 23, 2008 (JP) ..... 2008-134999

(51) Int. Cl.
*G03G 15/08* (2006.01)
*G03G 15/10* (2006.01)
*G03G 15/04* (2006.01)

(52) U.S. Cl. ..... 399/254; 399/30; 399/64; 399/119

(58) Field of Classification Search ..... 399/27, 399/30, 58, 61, 62, 64, 119, 148, 254, 255
See application file for complete search history.

(56) References Cited

U.S. PATENT DOCUMENTS 7,187,876 B2 * 3/2007 Ito et al. ..... 399/27
2003/0228160 A1 * 12/2003 Inoue et al. ..... 399/27

FOREIGN PATENT DOCUMENTS

JP 9-54488 2/1997
JP 2777906 5/1998
JP 3351179 9/2002
JP 2004-46011 2/2004

* cited by examiner

*Primary Examiner* — David Gray
*Assistant Examiner* — Joseph Wong
(74) *Attorney, Agent, or Firm* — Oblon, Spivak, McClelland, Maier & Neustadt, L.L.P.

(57) ABSTRACT

A toner containing section contains toner, and includes a toner stirring member penetrating the toner containing section for stirring the toner. A rotation member is attached to the toner stirring member and revolves around a rotational shaft of the toner stirring member. A pushing member revolves around the rotational shaft of the toner stirring member to push the rotation member. A stopper section having a stopper body is provided to contact the rotation member. An optical detection device is provided to detect the rotation member temporarily stopping at the stopper section. The rotation member separates from the pushing member by own weight and stops at the stopper section waiting for arrival of the pushing device thereon when an amount of toner remaining in the toner containing section decreases to a prescribed level and the pushing member arrives at an upper dead point. The toner stirring member is formed in a crank sate partially plunging into the toner. The rotation member is attached to the toner stirring member at an outside of the toner containing section.

10 Claims, 7 Drawing Sheets

SENSOR SIGNAL WAVEFORM WHEN
TONER REMAIN NOT LESS THAN PRESCRIBED LEVEL
(FROM UPPER DEAD CENTER 135°)

SENSOR SIGNAL WAVEFORM WHEN
TONER REMAIN NOT MORE THAN PRESCRIBED LEVEL
(FROM UPPER DEAD CENTER 45°)

TONER STIRRING DEVICE HAVING A PUSHING MEMBER AND ROTATION MEMBER FOR AN IMAGE FORMING APPARATUS

CROSS REFERENCE TO RELATED APPLICATION

This application claims priority under 35 USC §119 to Japanese Patent Application Nos. 2008-105554 and 2008-134999 filed on Apr. 15 and May 23 both 2008, respectively, and the entire contents of which are herein incorporated by reference.

BACKGROUND OF THE INVENTION

1. Field of the Invention

The present invention relates to an image forming apparatus, such as a copier, a printer, a facsimile, etc.

2. Discussion of the Background Art

Conventionally, in a developing device included in the image forming apparatus, toner is replenished and stirred by a toner-stirring member. Further, a toner amount detection device is provided in the developing device to monitor a replenished amount of toner. Various toner amount-detecting devices that detect such a toner amount have been proposed. For example, the Japanese Patent Application Laid Open No. 2004-46011 discloses a technology capable of detecting a toner remaining amount by detecting a torque applied to a toner-stirring member. However, since toner viscosity changes in accordance with a change of ambient temperature of the image forming apparatus, the detection is hardly accurately performed. Further, the Japanese Patent Application Laid Open No. 9-54488 discloses a toner-stirring device that includes a magnetic sensor that detects a toner remaining amount based on permeability of the toner.

However, the toner-stirring device is used only in a toner hopper, in which toner density does not change. Specifically, when the toner density changes, shortage of the toner can hardly be detected accurately.

Further, the Japanese Patent Application registration No. 3351179 discloses a technology in which a rotation member is pushed and rotated by a toner-stirring member when a developing device is sufficiently replenished with toner. Then, the rotation member drops by gravity and goes ahead of the toner-stirring member to be detected when an amount of remaining toner decreases. Further, a stopper is provided to contact the rotation member plunging below a draft surface of the toner not to be erroneously detected by the toner detection sensor. Because, when the rotation member naturally drops and contacts the stopper, the rotation member decreases its dropping speed and is prevented from plunging under the draft surface of the toner when landing thereon. Thus, the toner draft surface can credibly wait for arrival of an arm of the toner-stirring member. However, since such a technology again employs a magnetic sensor, shortage of remaining toner therein can hardly be detected accurately.

As a technology capable of accurately detecting a toner remaining amount even when toner density changes, a toner empty detection device that employs an optical sensor has been known. For example, the Japanese Patent Application registration No. 2777906 employs a construction, in which a detection objective member is driven rotated and is covered by a detection member cover when toner is sufficiently replenished, and protrudes and is detected by a sensor when an amount of the toner decreases to be short. In such a construction, when the toner is used up, the toner attracts and sticks in a gap between a ring section of a detection member 29 and a shaft 28A inserted into the ring section as shown in FIGS. 3 and 4 in the publication, so that the detection member 29 hardly drops by gravity in relation to the shaft 28A as a rotation center.

In conventional configurations including the above mentioned ones, the rotation member is either detected when it contacts the toner draft surface and its own gravity matches with a resistance of the toner thereby stopping at the toner draft surface or when the toner disappears from a rotational region of the rotation member and the rotation member stops at a bottom dead point. However, in the former configuration, the toner draft surface has unevenness, and the rotation member stops below the toner draft surface more than a little. Since such a phenomenon is affected by many disturbances such as environment of temperature, humidity, etc., a practical performance of the rotation member is unavoidably different from a designing goal. In the latter configuration, since toner massed together on the inner wall surface of the toner container section blocks a movement of the rotation member, toner near end cannot be detected even though only a small amount of toner remains. Otherwise, since the rotation member returns in the reverse direction after passing through the bottom dead point, detection results in erroneous.

SUMMARY OF THE INVENTION

The present invention has been made in view of the above noted and another problems and one object of the present invention is to provide a new and noble image forming apparatus. Such a new and noble image forming apparatus includes a toner containing section that contains toner and includes a toner stirring member penetrating the toner containing section for stirring the toner. A rotation member is attached to the toner stirring member and revolves around a rotational shaft of the toner stirring member. A pushing member revolves around the rotational shaft of the toner stirring member to push the rotation member. A stopper section having a stopper body is provided to contact the rotation member. An optical detection device is provided to detect the rotation member temporarily stopping at the stopper section. The rotation member separates from the pushing member by own weight and stops at the stopper section waiting for arrival of the pushing device thereon when an amount of toner remaining in the toner containing section decreases to a prescribed level and the pushing member arrives at an upper dead point. The toner stirring member is formed in a crank state partially plunging into the toner. The rotation member is attached to the toner stirring member at an outside of the toner containing section.

In another embodiment, the pushing member is attached to a rotation member attached to the toner stirring member via a bearing at an outside of the toner containing section.

In yet another embodiment, the rotation member includes a gear and the pushing member is attached to the side surface of the gear.

In yet another embodiment, the stopper section includes a flexible member that holds the stopper body at a prescribed position.

BRIEF DESCRIPTION OF DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENT

Figure 1:
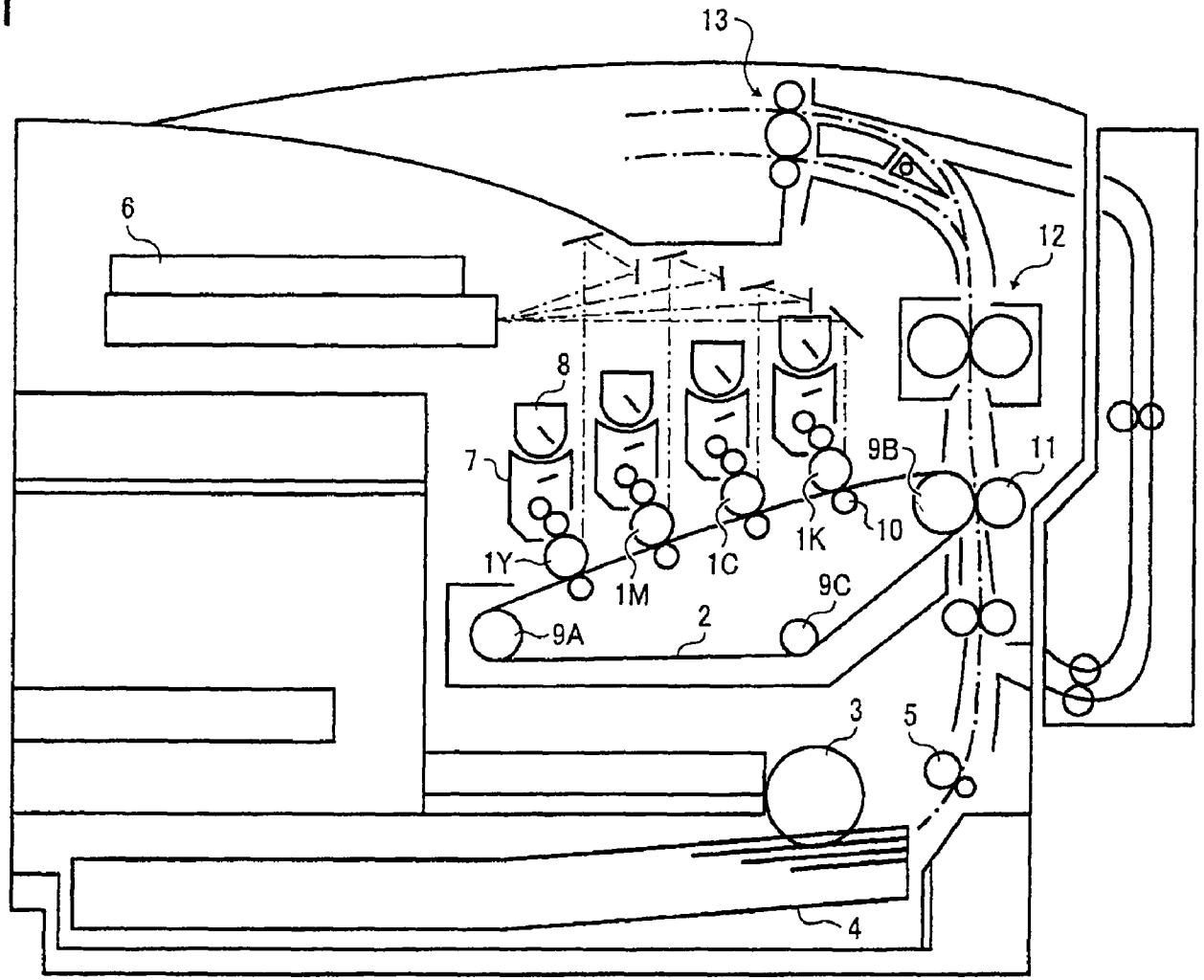
FIG. 1 illustrates an exemplary image forming apparatus according to a first embodiment of the present invention.

Referring now to the drawings, wherein like reference numerals and marks designate identical or corresponding parts throughout several figures, in particular in FIG. 1, the first embodiment is described. As shown, plural image carriers 1Y to 1K, for yellow, magenta, cyan, and black uses, respectively, are arranged in parallel to each other in a color image forming apparatus of a tandem type.

Toner images formed there are superimposed on an intermediate transfer belt 2 to be four color toner images. At the bottom of the image forming apparatus, a sheet feed roller 3 is arranged. When the sheet feed roller 3 rotates, a transfer sheet is fed from a sheet-feeding cassette 4. The transfer sheet fed from the sheet-feeding cassette 4 is conveyed by a pair of conveyance rollers 5 toward a secondary transfer nip.

Since a transfer bias is applied to a secondary transfer roller 11, a toner image is transferred from the intermediate transfer belt 2 to the transfer sheet conveyed to a nip formed between the intermediate transfer belt 2 and the secondary transfer roller 11. The transfer sheet with the transferred toner image is conveyed to a fixing device 12. In the fixing device 12, the full color image is fixed onto the transfer sheet by heat and nip pressure. The transfer sheet subjected to the fixing process at the fixing device 12 is then ejected onto a sheet ejection stack section from the sheet ejection roller 13. When a monochrome image of black is to be formed, the intermediate transfer belt 2 is further inclined by a mechanism, not shown, toward the left below side in the drawing so that the upper suspending surface separates from the image bearers of 1Y to 1C. Then, only the image bearer of 1K among the four image bearers 1Y to 1K is rotated to form a K-toner image. At this moment, the developing devices 7 are also stopped their operations beside image bearers 1 for Y to K.

Back to the color image formation, an optical write unit 6 includes a light source, a polygon mirror, a fθ (theta) lens, and a reflection mirror or the like, not shown, and emits a laser light to the surface of the image bearer 1 in accordance with image data. Then, a surface voltage of each of the image bearers 1 uniformly charged by a charge device attenuates at a section where the laser light is emitted, and thereby a latent image is formed there by the attenuation. The latent images formed in this way are developed by the developing devices 7Y to 7K to be toner images. Plural toner replenishing devices 8Y to 8K are provided in developing devices 7Y to 7K, respectively. The toner images formed on the image bearers 1 are transferred onto the intermediate transfer belt 2 as a primary transfer. Since toner remains on each of the surfaces of the image bearers 1 after the primary transfer, each of cleaning devices, not shown, cleans the surface of the image bearer 1. Then, passing through each of lubricant coating devices, a charge on the surface of the image bearer 1 is removed by a charge remover and is uniformly charged by the charge device thereby returning to the initial state.

The intermediate transfer belt 2 includes driving, driven, tension, and four primary transfer rollers 9A, 9B, 9C and 10Y to 10K. The intermediate transfer belt 2 travels endlessly being rotated by the driving roller 9A driven by a motor. The four rollers 10Y to 10K are arranged contacting the inner surface of the intermediate transfer belt 2 while each being supplied with a primary transfer bias voltage by a power source, not shown. The primary transfer rollers 10Y to 10K form primary transfer nips by pressure-contacting the inner surface of the intermediate transfer belt 2 against the image bearers 1Y to 1K. Then, primary transfer electric fields are created between the image bearers 1Y to 1K and the primary transfer rollers 10Y to 10K by the primary transfer bias voltages, respectively.

The Y toner image formed on the image bearer 1Y is transferred onto the intermediate transfer belt 2 as a primary transfer by the primary transfer electric filed and the nip pressure. The Y toner image is then superimposed in turn with toner images M to K formed on the image bearers 1M to 1K, respectively. With such superimposing, a four superimposed toner image is formed on the intermediate transfer belt 2.

Figure 2:
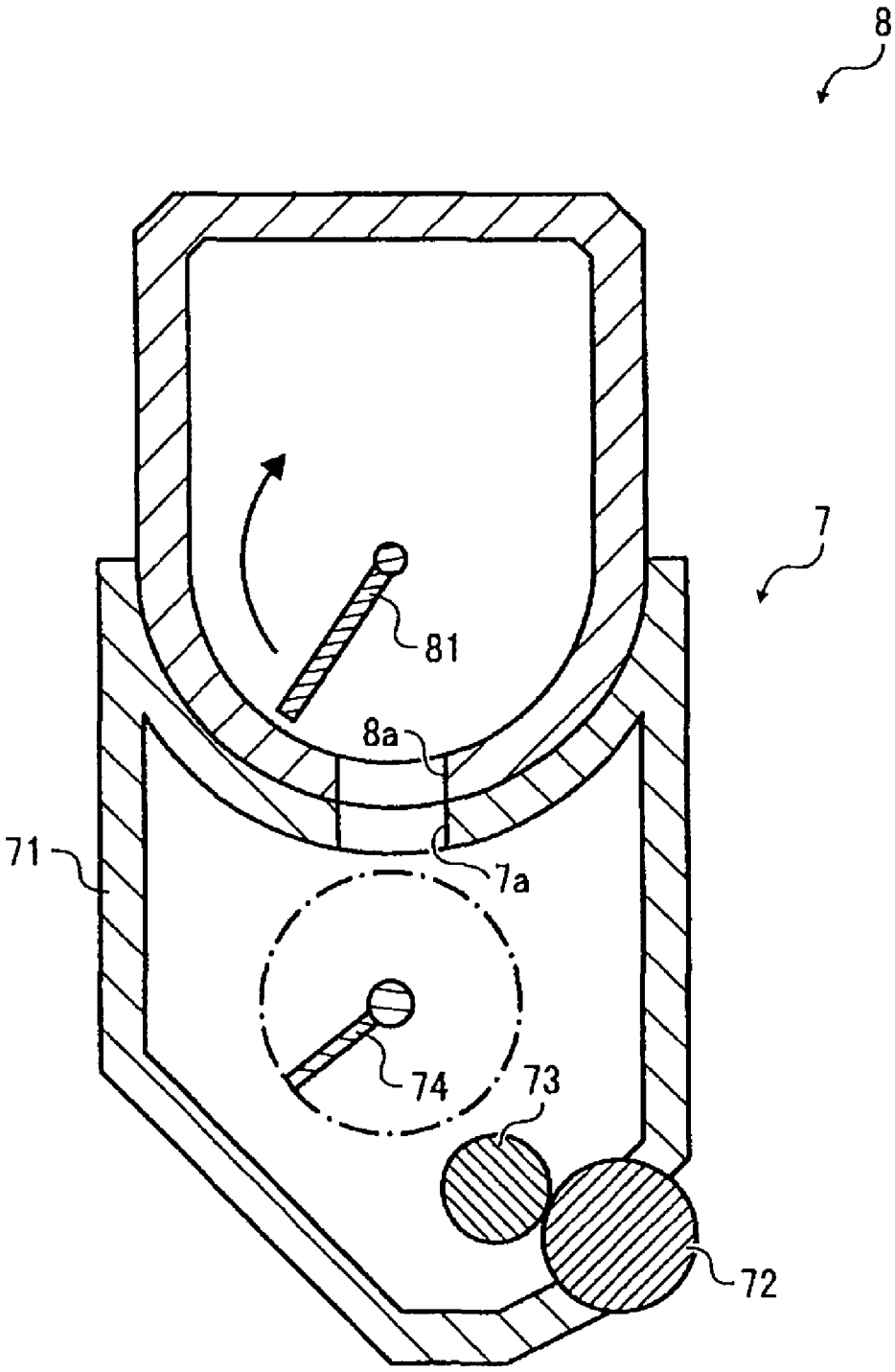
FIG. 2 specifically illustrates an exemplary developing device included in the image forming apparatus of FIG. 1.

Now, details of the developing device 7 and a toner-replenishing device 8 are described with reference to FIG. 2. As shown, the toner-replenishing device 8 is arranged above the developing device 7 separately. Thus, when an amount of toner remaining in the developing device 7 decreases less than a prescribed level, toner can be replenished by replacing the toner-replenishing device 8 with a new. Then, when a paddle 81 provided in the toner-replenishing device 8 rotates, the toner is replenished into the developing device 7 via openings 8*a* and 7*a* formed on the toner-replenishing device 8. The developing device 7 includes a toner container section 71 serving as a toner container. The toner container section 71 includes a developing roller 72 that supplies toner to the surface of the image bearer 1, a toner supply roller 73 that supplies the toner to the developing roller 72, and a toner-stirring member 74 that stirs the toner stored in the toner containing section 71.

Figure 3:
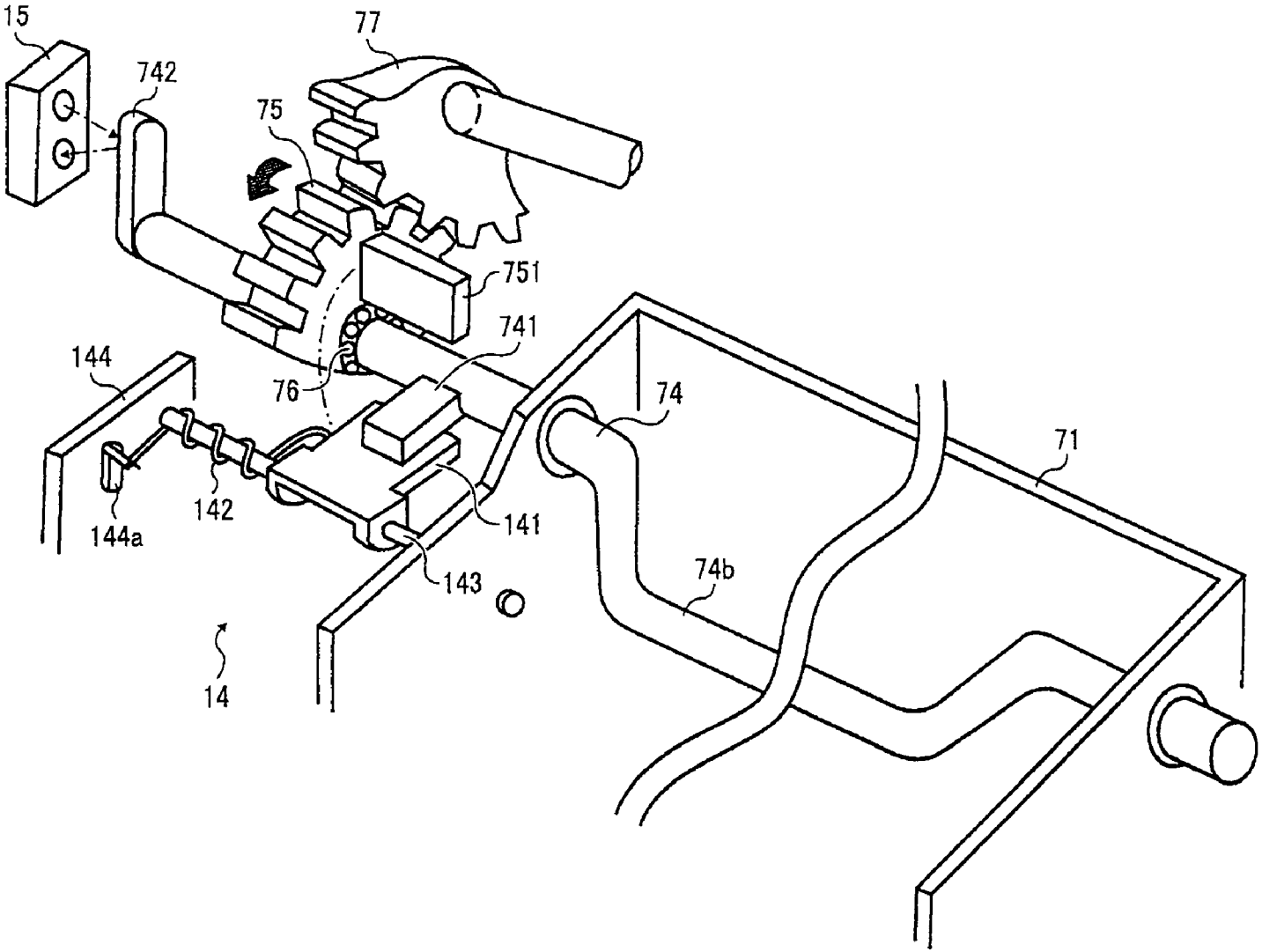
FIG. 3 illustrates an exemplary driving mechanism of a toner-stirring member included in the developing device of FIG. 2.

Now, an exemplary driving mechanism for the toner-stirring member 74 is described with reference to FIG. 3. As shown, the toner containing section 71 includes a crank state toner-stirring member 74 being inserted thereto.

A crank section 74*b* of the toner-stirring member 74 sinks into the toner during usage. When an amount of the toner decreases and the crank section 74*b* passes through the top-most position, i.e., at the twelve o'clock position (e.g. the upper death point), a shaft state toner stirring member 74 rotates by the weight of the crank section 74*b*. Specifically, the toner-stirring member 74 exerts both functions of a stirring member and the detector as mentioned in the Japanese Patent Application registration No. 2777906. Further, since there is neither a shaft nor a ring as in the Japanese Patent Application registration No. 2777906, rotational malfunction of the detector owning to attraction and firm sticking of the toner does not occur as a feature of this embodiment. Then, to realize this configuration, an improvement is made to a mechanism.

In this embodiment, a gear 75 as a rotation member is arranged on a section of the toner-stirring member 71, which protrudes from the wall member of the toner containing section 71. A bearing 76 is provided between the gear 75 and the toner-stirring member 74. Specifically, it is attempted that even when a driving force is conveyed from a driving source, not shown, via a gear 77 and the gear 75 rotates, the toner stirring member 74 does not rotate due to the bearing 76. On one side surface of the gear 75, a pushing member 751 is provided to push a rotation member 741. The rotation member 741 makes a revolving movement around a rotation a shaft of the toner-stirring member 74 formed thereon. In contrast to the pushing member that pushes the detection member integrally formed with the toner-stirring member in the Japanese Patent Application registration No. 2777906, the pushing member of this embodiment is attached to the gear 75 freely rotatably arranged on the toner-stirring member 74 via the bearing 76. With the above-mentioned configuration, the toner-stirring member 74 realizes both of the functions of the stirring member and the detecting member. Of course, the gear 75 or the bearing 76 can be omitted as far as the pushing member 751 can make revolving movement around the rotational shaft of the toner-stirring member 74. For example, a wheel suspended and driven by a V-belt is employed instead of the gear 75 as a rotation member.

The pushing member 751 is a cubic piece state, and is fit into a groove formed on the one side surface of the gear. Otherwise, the pushing member 751 can be formed integral with the gear 75 by injection molding. The gear 75 and the rotation member 741 can be made of any material. For example, metal or plastic material can be used. The rotation member 741 is driven rotated by the pushing member 751 when pushed by the pushing member 751. When the gear 75 rotates upon receiving a driving force from the driving source, not shown, via the gear 77, the pushing member 751 makes the revolving movement and arrives at the upper dead point. In this embodiment, when an amount of toner remaining in the toner containing section 71 and the pushing member 751 arrives at the upper dead point, the rotation member 741 separates from the pushing member downward by its own weight. The rotation member 741 then contacts a stopper body 141 and stops there to wait for arrival of the pushing member 751. More specifically, when an amount of toner remaining in the toner containing section 71 decreases to a prescribed level, the crank section 74*b* partially separates from the toner in the rotational region therein and a rotation resistance of the toner stirring member 74 decreases during its rotation, the toner-stirring member 74 rotates by its own weight. Thus, the rotation member 741 separates and moves downward from the pushing member 751 that conveys the driving force. Then, the rotation member 741 contacts the stopper body 141 having flexibility. The stopper body 141 is arranged on the stopper section 14. Beside the stopper body 141, the stopper section 14 includes a coil spring 142 made of an elastic member that maintains the stopper body 141 at a prescribe position, a rotational shaft extending along the center of the coil spring 142 serving as a rotation center of the stopper body 141, and a plate section 144 having a connection section 144*a* that supports one end of the rotational shaft 143 and connects to one end of coil spring 142.

When the rotation member 741 contacts the stopper body 141, the rotation member 741 temporarily stops on the stopper body 141. When rotation member 741 temporarily stops on the stopper body 141, a long plate state shield reflection section 742 formed on one end of the shaft state toner-stirring member 74 extends in a vertical direction. At this moment, an optical sensor 15 detects the shield reflection section 742. Specifically, the optical detection device is configured by the shield reflection section 742 and the optical sensor 15. When the shield reflection section enters a sensing region of the optical sensor 15, a light emitted from the optical sensor 15 is reflected by the shield reflection section 742 and enters a photodiode included in the optical sensor 15. When the photodiode sensor receives the reflection light and an optical current flows, the existence of the shield reflection section 742 is recognized. Beside the photodiode, a phototransistor can be employed. Further, a light to be emitted can include various light sources such as a xenon lamp, a tungsten lamp, a LED, etc.

As mentioned earlier, when the rotation member 741 contacts the stopper body 141, the rotation member 741 temporarily stops thereon. Then, when the gear 75 further rotates after that and a prescribed period has elapsed, the pushing member 751 catches up and contacts the rotation member 741. Then, the rotation member 741 pushed by the pushing member 751 providing a revolving movement at a prescribed speed passes through the stopper section 14 while depressing the stopper body 141 downward. The stopper body 141 is held by the coil spring 142 and rotates around the rotational shaft 143 against a bias of thereof. The stopper body 141 can be made of flexible material so that the rotation member 741 and the pushing member 751 can more readily pass the stopper section 14. Specifically, by employing the flexible material, the stopper body 141 can be bent downward at the same time when depressed downward. As a result, the rotation member 741 and the pushing member 751 can smoothly pass through the stopper body 14. Then, after the pushing member 751 passes through the stopper section 14, the stopper section returns to an original shape. The pushing member 751 passing through the stopper section 14 pushes and rotates the rotation member 741, thereby arriving again at the upper dead point.

Figure 4:
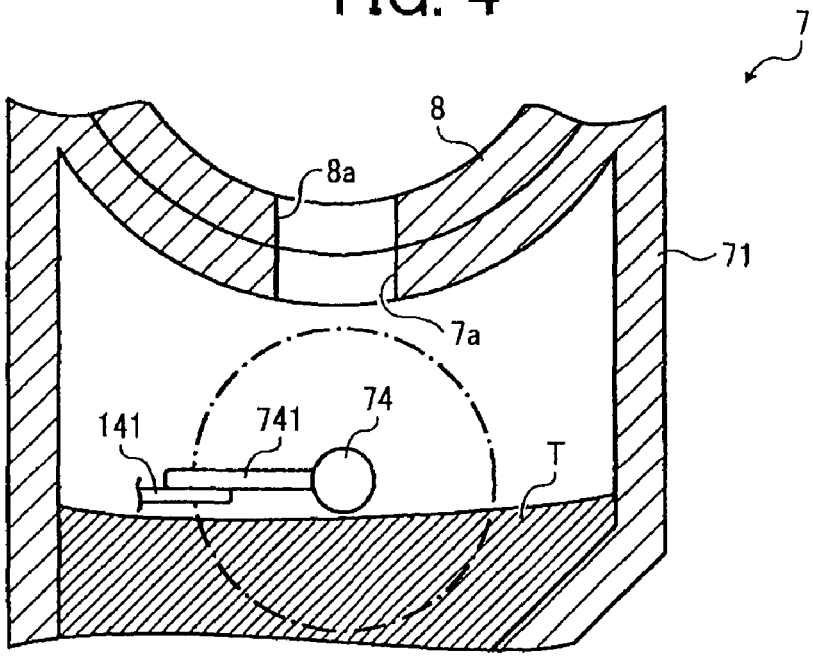
FIG. 4 illustrates an exemplary condition in a toner containing section, in which a draft surface of the toner therein is located below a rotation center of the toner-stirring member.
Figure 5:
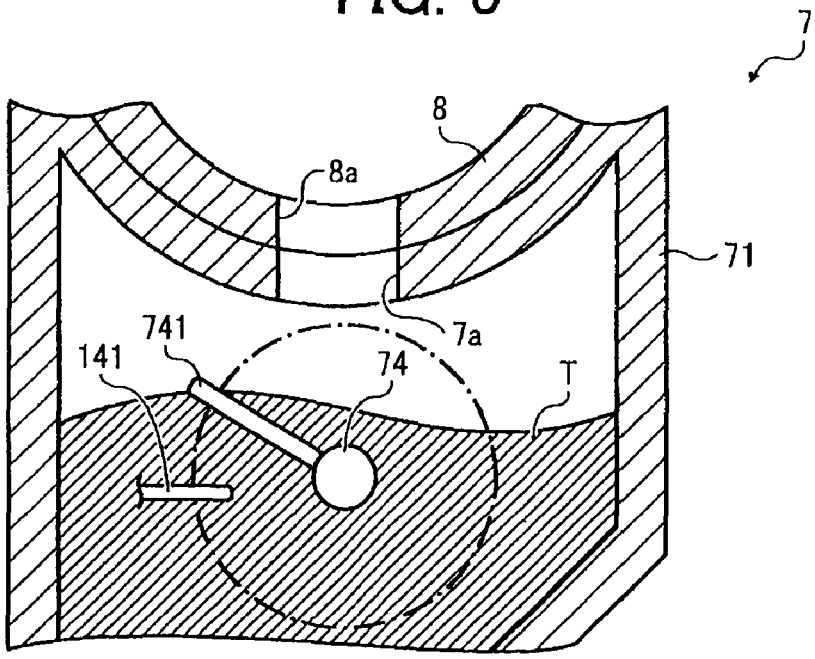
FIG. 5 illustrates an exemplary condition in a toner containing section, in which a draft surface of the toner therein is located above the rotation center of the toner-stirring member.

An exemplary condition in which a toner-drafting surface is located below a rotational center of the toner-stirring member 74 in the toner containing section 71 is described in FIG. 4. As shown, the rotation member 741 temporarily stops at a position downstream of the upper dead point in a rotational direction by 90 degree. In such a configuration, the rotation member 741 can freely drop by gravity and easily contacts the stopper body 141. However, when the toner drafting surface is located above the rotational center of the toner stirring member 74 as shown in FIG. 5, the rotation member 741 dropping by it own weight stops at the drafting surface and cannot generally arrive at the stopper body 141. As a result, the rotation member 741 cannot temporarily be stopped at a prescribed position so that the optical sensor cannot detect the shield reflection section 742. Specifically, unless toner decreases to a prescribed level, the optical sensor 15 cannot detect the shield reflection section 742.

Figure 6:
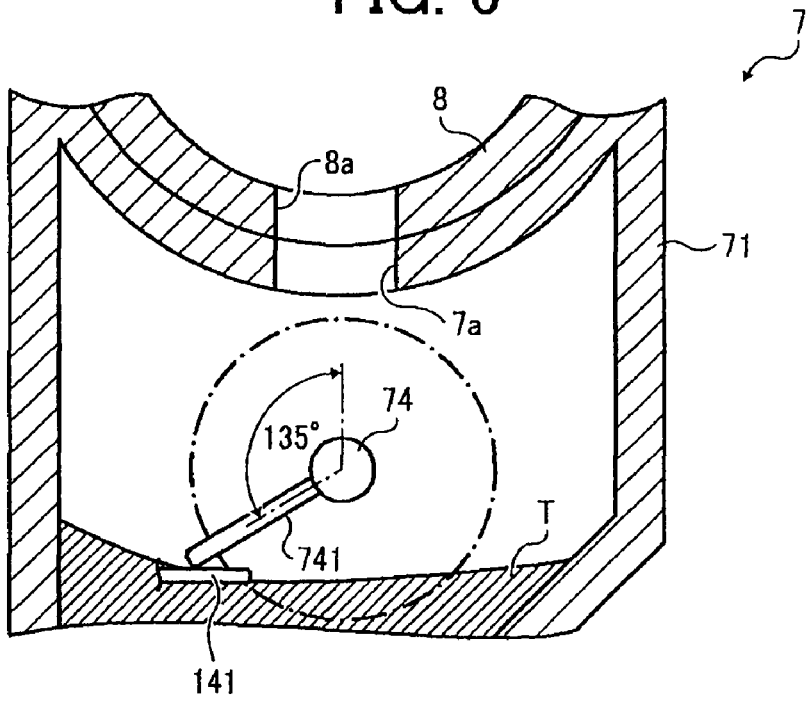
FIG. 6 illustrates an exemplary condition in a toner containing section, in which the rotation member contacts a stopper and temporally stops at a position downstream of the upper dead point in a direction of a rotation by the angle of 135 degree.

An exemplary condition in which the rotation member 741 contacts the stopper body 141 and temporarily stops at a position downstream of the upper dead point in a rotation direction by 135 degree is illustrated in FIG. 6.

Figure 7:
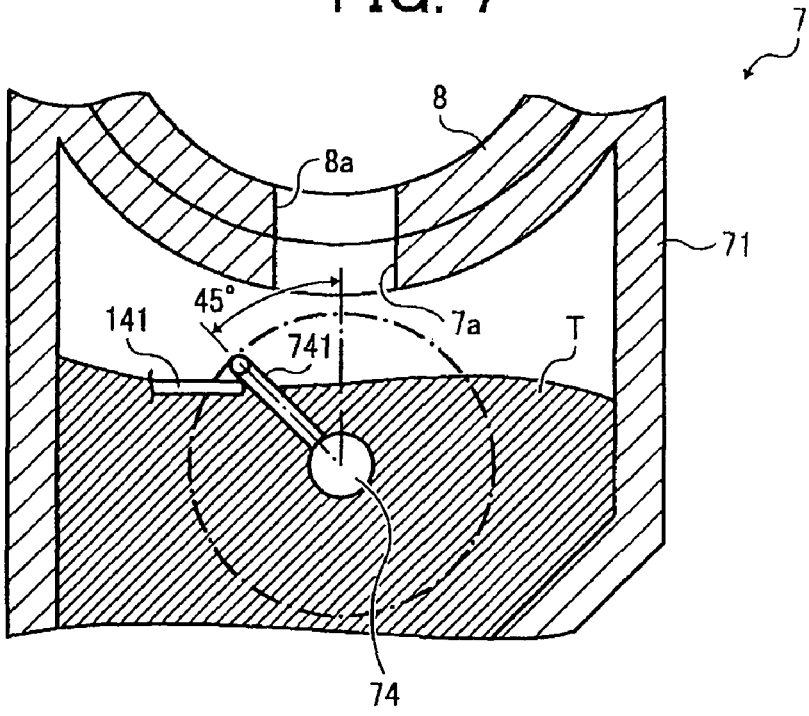
FIG. 7 illustrates an exemplary condition in a toner containing section, in which the rotation member contacts a stopper and temporally stops at a position downstream of the upper dead point in a direction of a rotation by the angle of 45 degree.

In such a configuration, the toner-drafting surface is located at a relatively lower level, the optical sensor can detect shortage of toner when the toner decreases down to such a level. An exemplary configuration in which the rotation member 741 contacts the stopper body 141 and temporarily stops at a position downstream of the upper dead point in a rotation direction by 45 degree is illustrated in FIG. 7. In such a configuration, the toner-drafting surface is located at a relatively higher level, the optical sensor detects shortage of toner when relatively a lot of toner T is replenished. In this embodiment, the position where the rotation member 741 contacts the stopper body 141 and temporarily stops is preferably determined to be downstream of the upper dead point in a rotation direction by about 45 to about 135 degree. Because, when the position is less than 45 degree, shortage of toner can be detected even not. Whereas when the position is more than 135 degree, shortage of the toner is detected later than when the toner practically becomes short.

Figure 8A:
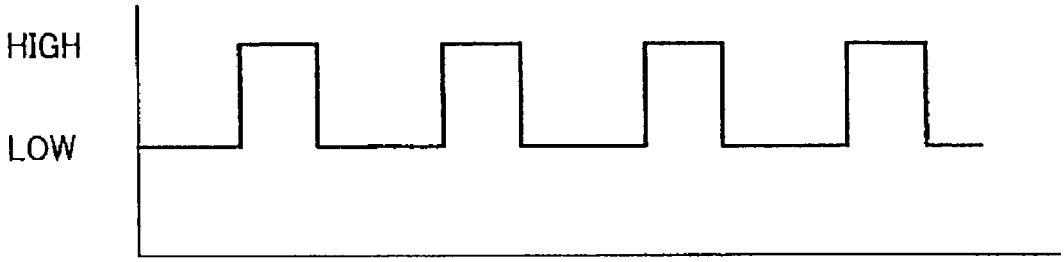
FIG. 8A illustrates an exemplary output signal of an optical sensor when the rotation member contacts a stopper and temporally stops at a position downstream of the upper dead point in a direction of a rotation by the angle of 135 degree.
Figure 8B:
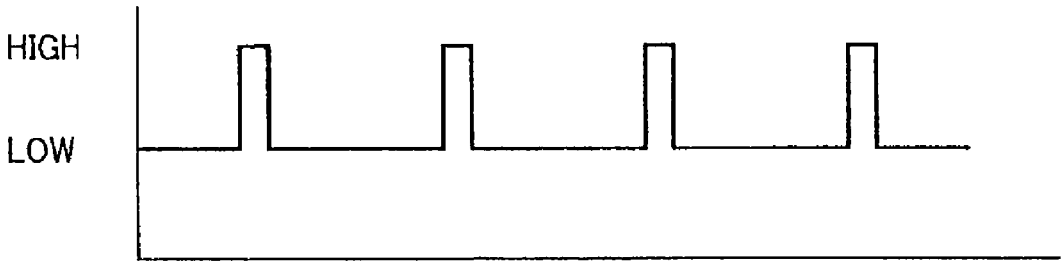
FIG. 8B illustrates an exemplary output signal of an optical sensor when the rotation member contacts a stopper and temporally stops at a position downstream of the upper dead point in an direction of a rotation by the angle of 45 degree.

Since black toner is consumed sooner than the other color toners in the image forming apparatus, shortage thereof is preferably detected at a toner remaining level higher than others. For example, shortage of the black toner can be detected at a position downstream of the upper dead point in the rotation direction by 45 degree, while the other colors of yellow, magenta, and cyan can be detected at a position downstream of the upper dead point in the rotation direction by 135 degree. Further, when the stopper body 141 is positioned at a lower level as shown in FIG. 6, a step width of a High signal of an output signal from the optical sensor 15 becomes wider than when the stopper body 141 is positioned downstream of the upper dead point in the rotation direction by 135 as show in FIG. 8. Because, the temporary stopping time becomes longer than when the stopper body 141 is positioned at the higher level as shown in FIG. 7.

Figure 9:
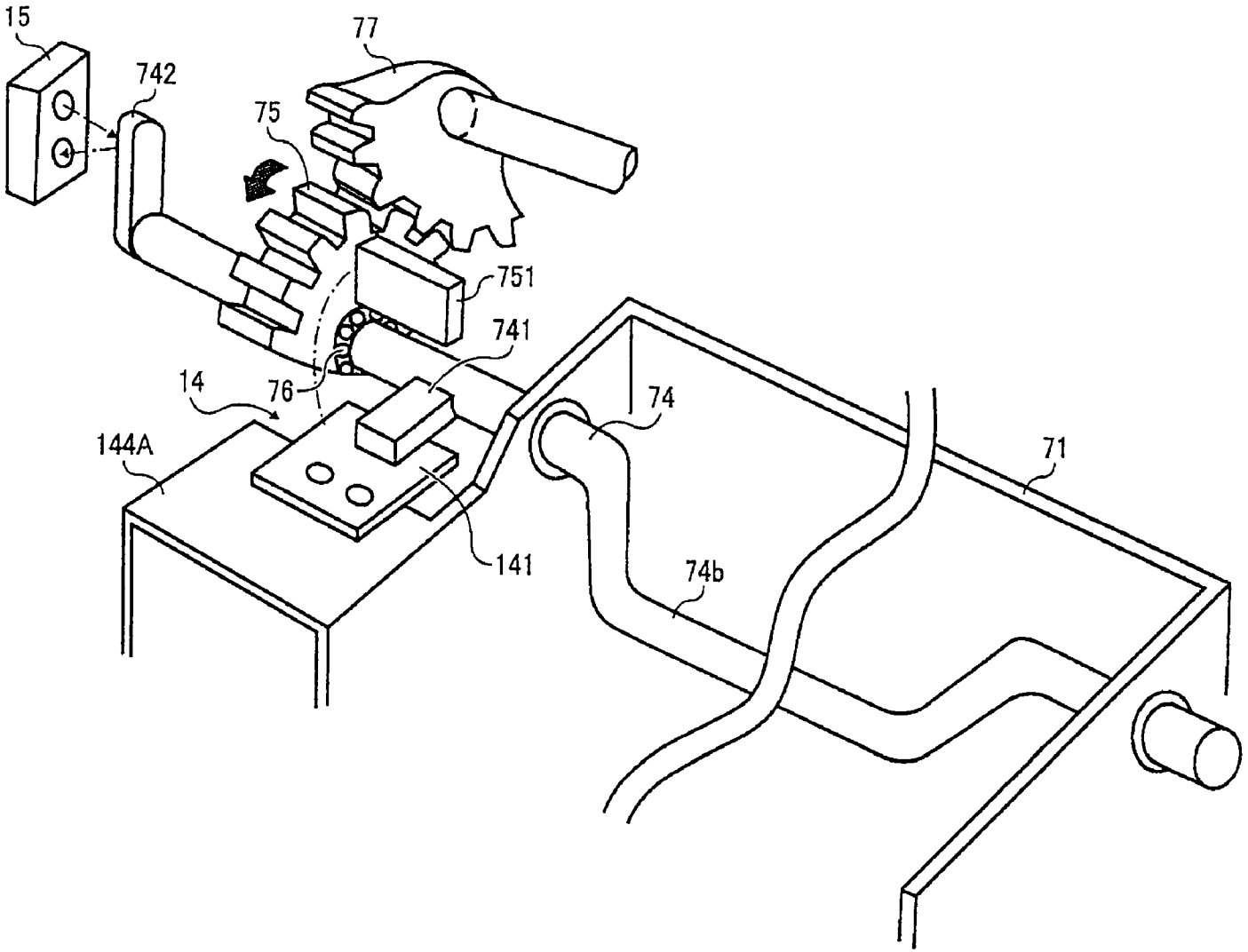
FIG. 9 illustrates an exemplary modification of the driving mechanism for the toner-stirring member included in the developing device of FIG. 2.

Heretofore, the stopper section 14 includes the stopper body 141 and the coil spring 142 and the like in the above-mentioned embodiment. However, as shown in FIG. 9, an elastic plate spring 141A can be secured to a table 144A. Such a configuration is simpler that that illustrated in FIG. 3, and capable of decreasing a number of parts.

ADVANTAGE OF THE EMBODIMENTS

The above-mentioned image forming apparatus can accurately detect shortage of remaining toner by using an optical detecting device even when toner density changes.

Obviously, numerous additional modifications and variations of the present invention are possible in light of the above teachings. It is therefore to be understood that within the scope of the appended claims, the present invention may be practiced otherwise than as specifically described herein.

What is claimed is:

1. An image forming apparatus, comprising:

at least one toner containing section configured to contain toner;

a developing roller configured to supply toner to an image bearer from the toner containing section;

a toner stirring member penetrating the toner containing section and configured to stir the toner stored in the toner containing section;

a first rotation member attached to the toner stirring member and configured to revolve around a rotational shaft of the toner stirring member;

a pushing member spaced apart from and configured to revolve around the rotational shaft of the toner stirring member and configured to push the first rotation member, the pushing member being located at an outside of the toner containing section;

a stopper section having a stopper body configured to contact the first rotation member; and an optical detection device configured to detect the first rotation member temporarily stopping at the stopper section;

wherein said first rotation member separates from the pushing member due to a weight of the first rotation member and stops at the stopper section waiting for arrival of the pushing device thereon when an amount of toner remaining in the toner containing section decreases to a prescribed level and the pushing member arrives at a upper dead point; and wherein said toner stirring member is formed in a crank state partially plunging into the toner; and wherein said first rotation member is attached to the toner stirring member at an outside of the toner containing section.

2. The image forming apparatus as claimed in claim 1, wherein said pushing member is attached to a second rotation member attached to the toner stirring member via a bearing.

3. The image forming apparatus as claimed in claim 2, wherein said second rotation member includes a gear, wherein said pushing member is attached to the side surface of the gear.

4. The image forming apparatus as claimed in claim 1, wherein said stopper section includes an elastic member configured to hold the stopper body at a prescribed position.

5. The image forming apparatus as claimed in claim 4, wherein said stopper body has flexibility.

6. The image forming apparatus as claimed in claim 1, wherein said stopper body includes elasticity.

7. The image forming apparatus as claimed in claim 1, further comprising:

a toner replenishing device detachable from the toner containing section, wherein when an amount of toner remaining in the toner containing section decreases to a prescribed level, the toner replenishing device is replaced with new one.

8. The image forming apparatus as claimed in claim 1, wherein the first rotation member contacts the stopper body and temporary stops at a position downstream of the upper dead point in the rotation direction by from about 45 to about 135 degree.

9. The image forming apparatus as claimed in claim 7, wherein said at least one toner containing section includes plural mono color toner containers, wherein black toner is replaced at a different time from when the remaining plural mono colors are replaced.

10. The image forming apparatus as claimed in claim 9, wherein the black toner is replaced when the amount of black toner is at a higher level than a level of toner of each of the remaining plural mono colors.

* * * * *